US007857147B2

(12) United States Patent
Mulaw

(10) Patent No.: US 7,857,147 B2
(45) Date of Patent: Dec. 28, 2010

(54) DISH RACK WITH SPLASH GUARD AND DISH TOWEL DRYING HANDLES

(76) Inventor: Azanaw Mulaw, 1901 Thistlewood Dr., Fort Washington, MD (US) 20744-3904

( * ) Notice: Subject to any disclaimer, the term of this patent is extended or adjusted under 35 U.S.C. 154(b) by 0 days.

(21) Appl. No.: 12/467,266

(22) Filed: May 16, 2009

(65) Prior Publication Data

US 2010/0059459 A1 Mar. 11, 2010

Related U.S. Application Data

(60) Provisional application No. 61/095,944, filed on Sep. 10, 2008.

(51) Int. Cl.
*A47G 19/08* (2006.01)

(52) U.S. Cl. ..... 211/41.3; 211/41.1; 211/41.2; 211/85.25; 220/572

(58) Field of Classification Search ..... 211/41.1–41.9, 211/85.25; 220/487, 488, 572; D3/55, 3; 4/654, 656

See application file for complete search history.

(56) References Cited

U.S. PATENT DOCUMENTS

| | | | | | |
|---|---|---|---|---|---|
| 211,739 | A * | 1/1879 | Hutchinson | 134/85 |
| 410,818 | A * | 9/1889 | Wilson | 220/572 |
| 725,825 | A * | 4/1903 | Cleek | 220/572 |
| 746,159 | A * | 12/1903 | Reeves | 220/572 |
| 917,278 | A * | 4/1909 | Fike | 134/92 |
| 1,252,220 | A * | 1/1918 | Benson | 220/4.03 |
| 2,632,568 | A * | 3/1953 | Abt | 211/41.3 |
| 2,931,514 | A * | 4/1960 | Hughes | 211/41.4 |
| 2,936,898 | A * | 5/1960 | Miguez | 211/41.3 |
| 5,158,184 | A | 10/1992 | Craft et al. | |
| 6,179,134 | B1 | 1/2001 | Pine et al. | |
| 6,491,170 | B1 | 12/2002 | Madela | |
| D490,198 | S * | 5/2004 | Jerstroem et al. | D32/55 |
| 6,763,954 | B1 * | 7/2004 | Travers et al. | 211/41.3 |
| 7,325,695 | B2 | 2/2008 | Yang et al. | |
| 7,407,059 | B2 * | 8/2008 | Sullivan et al. | 211/41.3 |
| 2006/0283817 | A1 * | 12/2006 | Yang et al. | 211/41.4 |
| 2007/0131629 | A1 | 6/2007 | Sullivan et al. | |

* cited by examiner

*Primary Examiner*—Darnell M Jayne
*Assistant Examiner*—Patrick Hawn
(74) *Attorney, Agent, or Firm*—Louis Ventre, Jr.

(57) ABSTRACT

A dish rack comprises a tubular hub with a bottom segment and an outwardly flared top segment. An inner ledge supports a funnel and a flat-panel grate. The funnel may be molded together with the hub, eliminating the ledge. The rear of the hub is a vertical splash guard rising above the height of the front of the hub. A removable drainage tray is configured to slide into the bottom segment at the front of the hub. Cutouts on the bottom segment define hand-hold cavities. Handles are located on the exterior of the flared top segment to also serve as dish towel drying bars. The flat-panel grate is preferably configured with a slot to support and cradle a dish edge. An optional utensil holder is preferably configured to be supported by the flat-plate grate at the inner periphery of the flared top segment.

4 Claims, 7 Drawing Sheets

DISH RACK WITH SPLASH GUARD AND DISH TOWEL DRYING HANDLES

CROSS-REFERENCE TO RELATED APPLICATIONS

This application claims the benefit of U.S. Provisional Application No. 61/095,944, filed 10 Sep. 2008, which is hereby incorporated by reference herein.

TECHNICAL FIELD

In the field of support racks, a device to support a culinary plate during drying subsequent to washing.

BACKGROUND ART

Dish racks are commonly positioned next to a kitchen sink for drying tableware after hand washing. The water from washed plates, bowls, cups and utensils will typically drip onto a base mat, into a storage basin, or sometimes be directed into the sink with a spout.

An example of a typical wire basket dish rack is U.S. Pat. No. 7,325,695 teaching a dish rack with water drainage ramp out the front of the dish rack. This dish rack requires that it be located very near the sink so that the water flowing out the front of the dish rack flows into a discharge basin and not all over the counter. It provides no bar separate from the dish drain area for tidy dish towel storage and drying. It provides no means for sliding the dish rack to another location. It provides no splash guard against used dish water splashing on clean plates. And finally, it cannot be disassembled for ease of cleaning.

Another example is U.S. Pat. No. 5,158,184 that teaches a dish rack and drain tray assembly beneath the entire dish rack. The drain tray collects water and may be used as a lid once removed from underneath the dish rack. However, this typical dish rack does not make it easy to remove drain water because the rack must be first removed from the drain tray. It provides no splash guard against used dish water splashing on clean plates. It also cannot be disassembled for ease of cleaning.

Another example is U.S. Pat. No. 2,936,898 that discloses an inclined drying rack for dishes and tableware. While suffering from many of the same deficiencies as described above, this inclined rack or grate assists in drainage, but it makes it difficult for a person to move or carry the dish rack to a new location without upsetting the items being dried.

SUMMARY OF INVENTION

A dish rack has a tubular hub with a bottom segment and an outwardly flared top segment transitioning from the bottom segment at a transition point. An inner ledge at the transition provides a support for resting a funnel and a flat-panel grate. The rear of the tubular hub is flattened to provide an approximately vertical splash guard that rises above the height of the front of the tubular hub. A removable drainage tray is configured to slide into the bottom segment at the front of the tubular hub. A pair of cutouts on the bottom segment defines handhold cavities. Two or more handles are located on the exterior of the flared top segment and each is configured to hold dish towel. The flat-panel grate is preferably configured with a slot to support and cradle a dish edge. An optional utensil holder is preferably configured to be supported by the flat-plate grate at the inner periphery of the flared top segment.

TECHNICAL PROBLEM

Many complicated, unsightly and costly dish racks are available. These often needlessly consume precious counter space. A dish rack can be used to store dried tableware, but unfortunately such storage is usually in plain sight. Existing dish racks do not manage water well, and are often bulky and difficult or awkward to carry or slide to a new position when full. Existing dish racks do not have a splash guard to avoid splashing dirty dish water on clean plates. Finally, dish racks do not provide a tidy storage and drying bar, apart from the dish drying area, for a dish towel after use.

SOLUTION TO PROBLEM

What is needed is a compact, easy to clean, easy to slide and carry dish rack that collects the dripping water in an easily removable drainage tray, provides a splash guard, and also makes accommodation for neatly storing and drying a dish towel.

ADVANTAGEOUS EFFECTS OF INVENTION

The present invention is a highly efficient dish rack in that it consumes a minimum of counter space. A horizontal flat-panel grate within the dish rack improves ability to relocate the dish rack such that it can be carried or slid to a new position on the counter with ease. Drainage water is easily collected in a small drainage tray and then easily removed from the bottom front of the dish rack. The dish rack provides a plurality of convenient bars for dish towel drying and storage apart from the dish drying area in the form of handles on the dish rack. Finally, removable parts make the dish rack easy to clean.

BRIEF DESCRIPTION OF DRAWINGS

The drawings show preferred embodiments of the invention.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
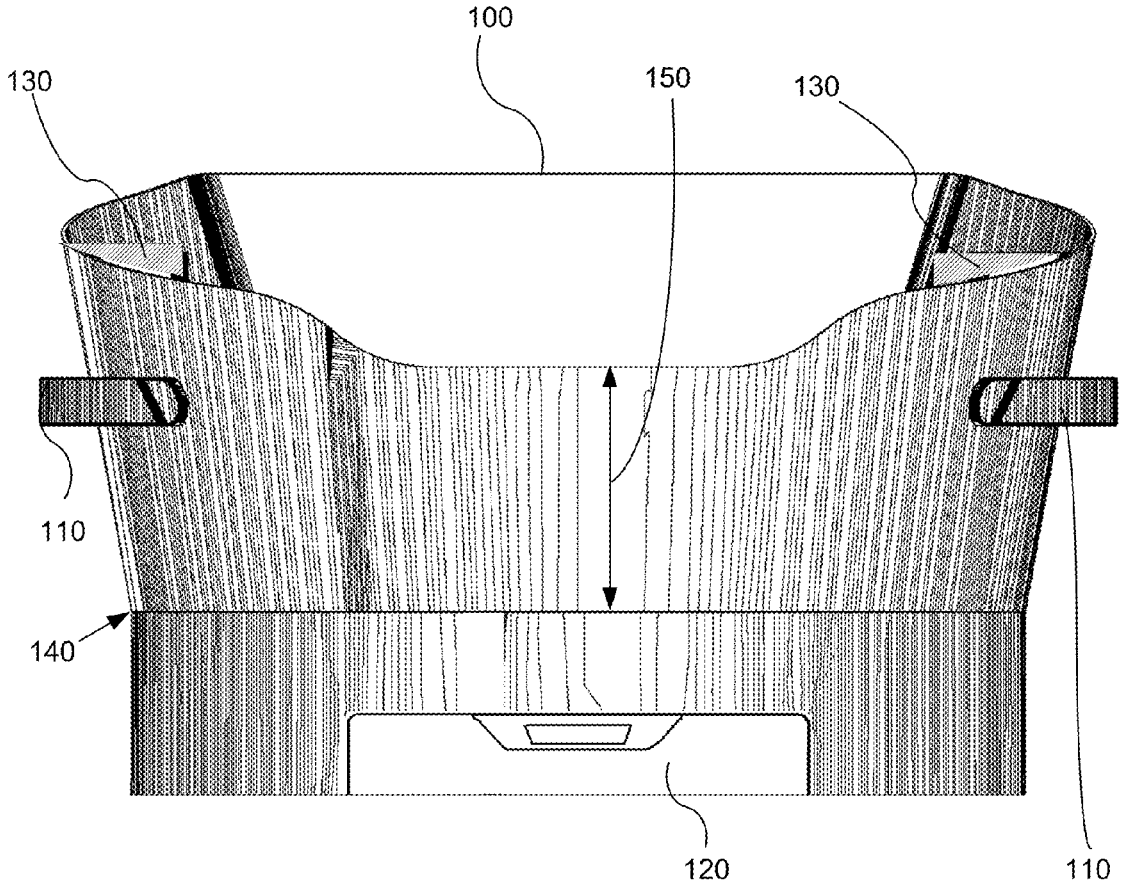
FIG. 1 is a frontal view of an assembled dish rack.
Figure 2:
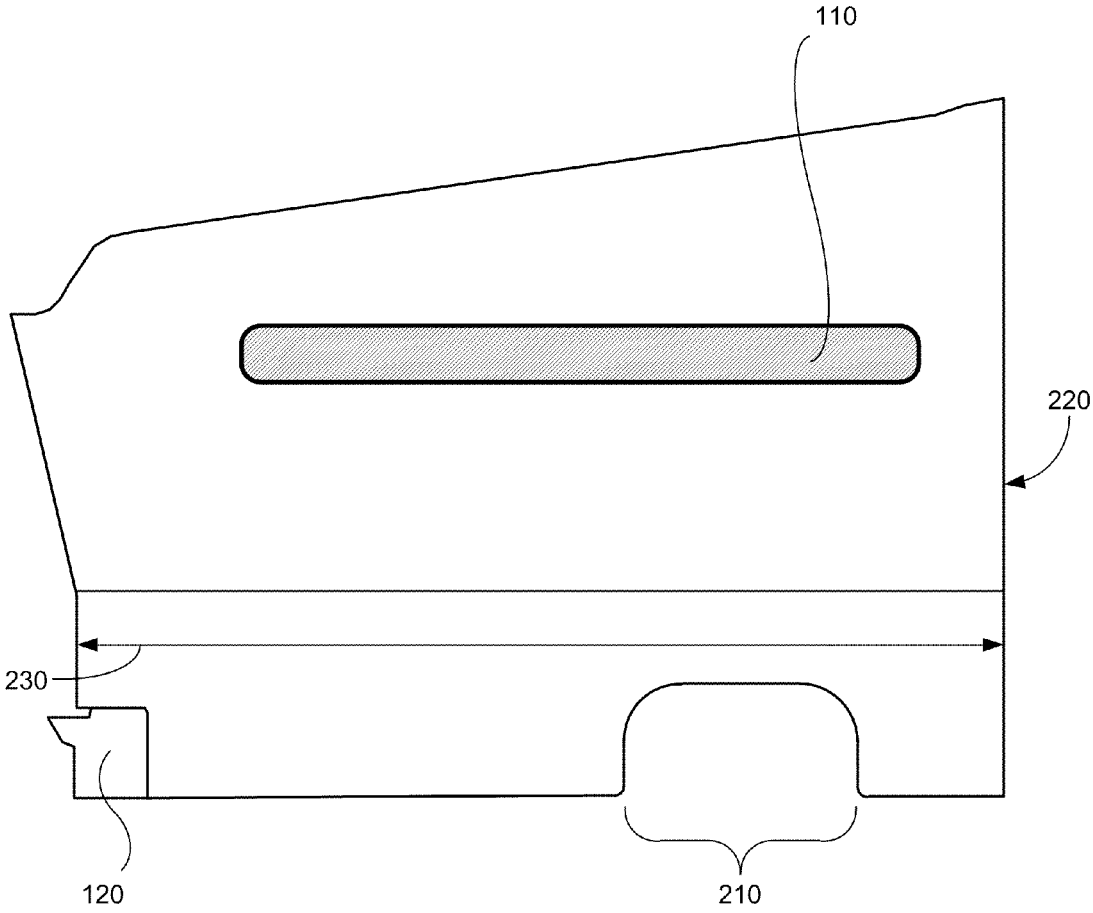
FIG. 2 is a side view of the dish rack.
Figure 3:
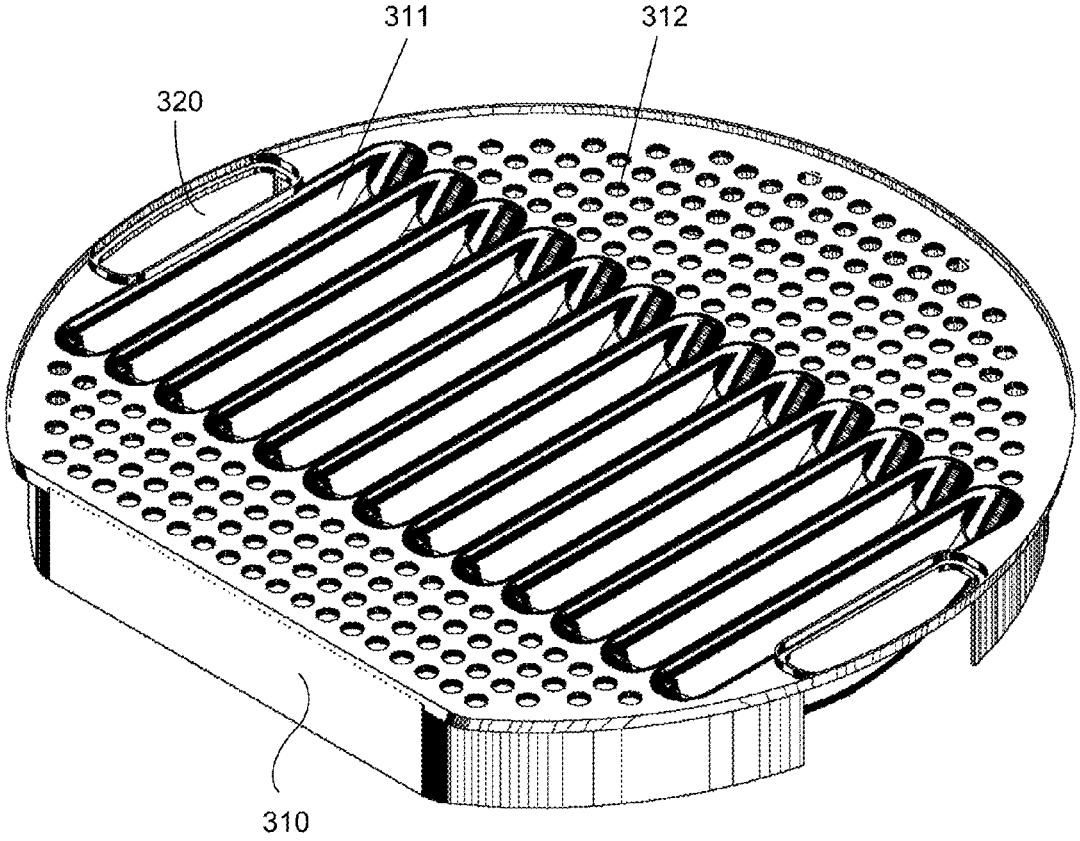
FIG. 3 is a rear perspective view of the flat-panel grate.
Figure 4:
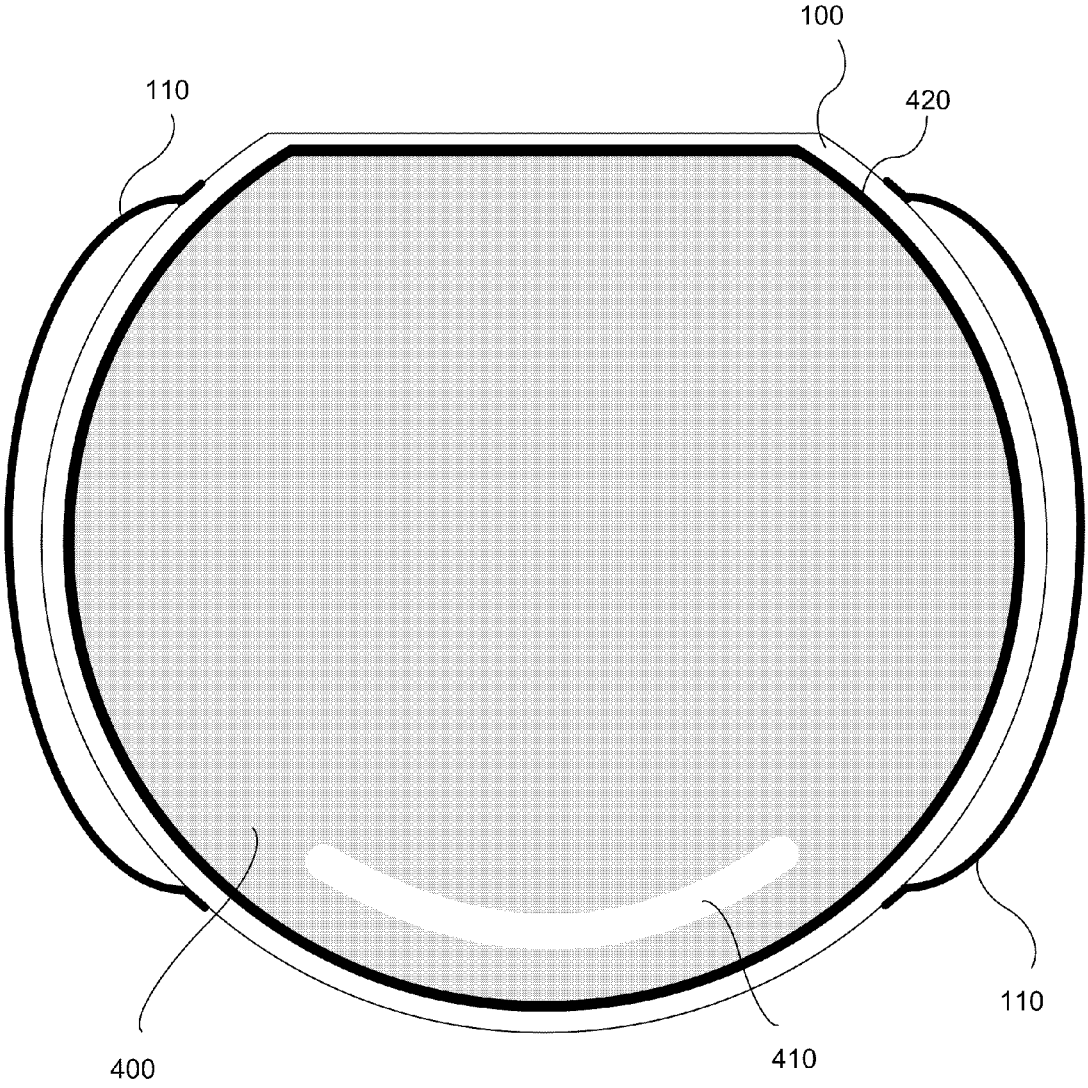
FIG. 4 is a top view of the funnel inside the tubular hub.

Reference is made to the figures for each component. The reference numbers in the drawings are used consistently throughout. Reference numbers with the 100 series are in FIG. 1. New reference numbers in FIG. 2 are given the 200 series numbers. Similarly, any new reference numbers in each succeeding drawing are given a corresponding series number beginning with the figure number.

A preferred embodiment of the dish rack of the present invention comprises: a tubular hub (100); a removable drainage tray (120); handles (110); a drainage funnel (400); a flat-panel grate (310); and, optionally, a removable utensil holder (130). Each such component is discussed in detail below.

The first component of the dish rack noted above is a tubular hub (100), which is the body or base of the dish rack. It is a tube-like container that is preferably open at its top and bottom. The tubular hub (100) is flattened at the rear into an approximately planar vertical wall (220).

The tubular hub (100) has a bottom segment (510) that is configured to stand approximately vertically. The bottom segment (510) has an approximately elliptical front portion (230); and, a rear portion defining an approximately planar vertical wall (220). The bottom segment (510) is further configured with a pair of cutouts (210) on opposing sides of the bottom segment (510) to define hand-hold cavities. The bottom segment (510) is further configured with a drawer opening at the bottom of the front portion (230), preferably configured to be opposite to the planar vertical wall (220), allowing the removable drainage tray (120) to slide into the bottom segment (510).

The tubular hub (100) has a top segment (520) transitioning from the bottom segment (510) at a transition point (140), wherein the top segment (520) is flared outwardly beginning at the transition point (140) to a vertical height (150) and along the front portion (230) of the bottom segment (510), and extending the planar vertical wall (220) of the bottom segment to a point above the vertical height (150).

The tubular hub (100) has a ledge (420) at the transition point projecting radially inward. The ledge (420) is a support structure upon which rests the funnel (400) and the flat-panel grate (310) when the dish rack is assembled. The ledge (420) is inwardly projecting ridge and is preferably also on the planar vertical wall (220) so that ledge (420) extends around the internal circumference of the tubular hub (100).

Figure 6:
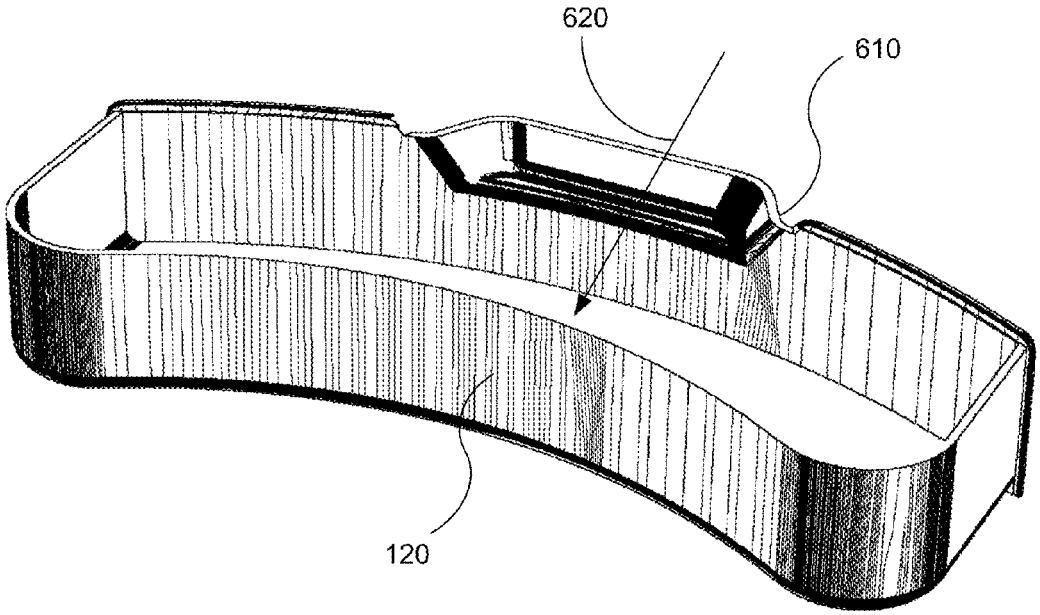
FIG. 6 is a rear perspective view of the removable drainage tray.

The second component of the dish rack noted above is a removable drainage tray (120), which is shown in perspective in FIG. 6. The removable drainage tray (120) is configured to slide into the drawer opening in the bottom segment (510). The removable drainage tray (120) receives drainage water from above and can be removed to empty the water. A pull bar (610) is configured to create a line of sight (620) to a water level within the removable drainage tray when the removable drainage tray (120) is fully inserted in the tubular hub (100). This pull bar (610) configuration allows a user to see the collected water level when the removable drainage tray (120) is fitted within the tubular hub (100) so that it can be easily determined when the removable drainage tray (120) needs to be emptied.

The third component of the dish rack noted above comprises handles (110) on the exterior of the top segment (520). There are preferably two handles (110) on opposing sides of the tubular hub (110) that are formed as a single piece with the tubular hub (100), but may also be attached. Each handle is configured to hold a dish towel and may also be used to grasp and move the dish rack, in addition to the cutouts (210) that define hand-hold cavities on the bottom segment (510).

The fourth component of the dish rack noted above is a drainage funnel (400). The drainage funnel (400) is configured to rest on the ledge and collect water and flow water into the removable drainage tray (120). As with any funnel, it defines a hole (410) to drain water into the removable drainage tray (120) located immediately below the hole (410).

Figure 7:
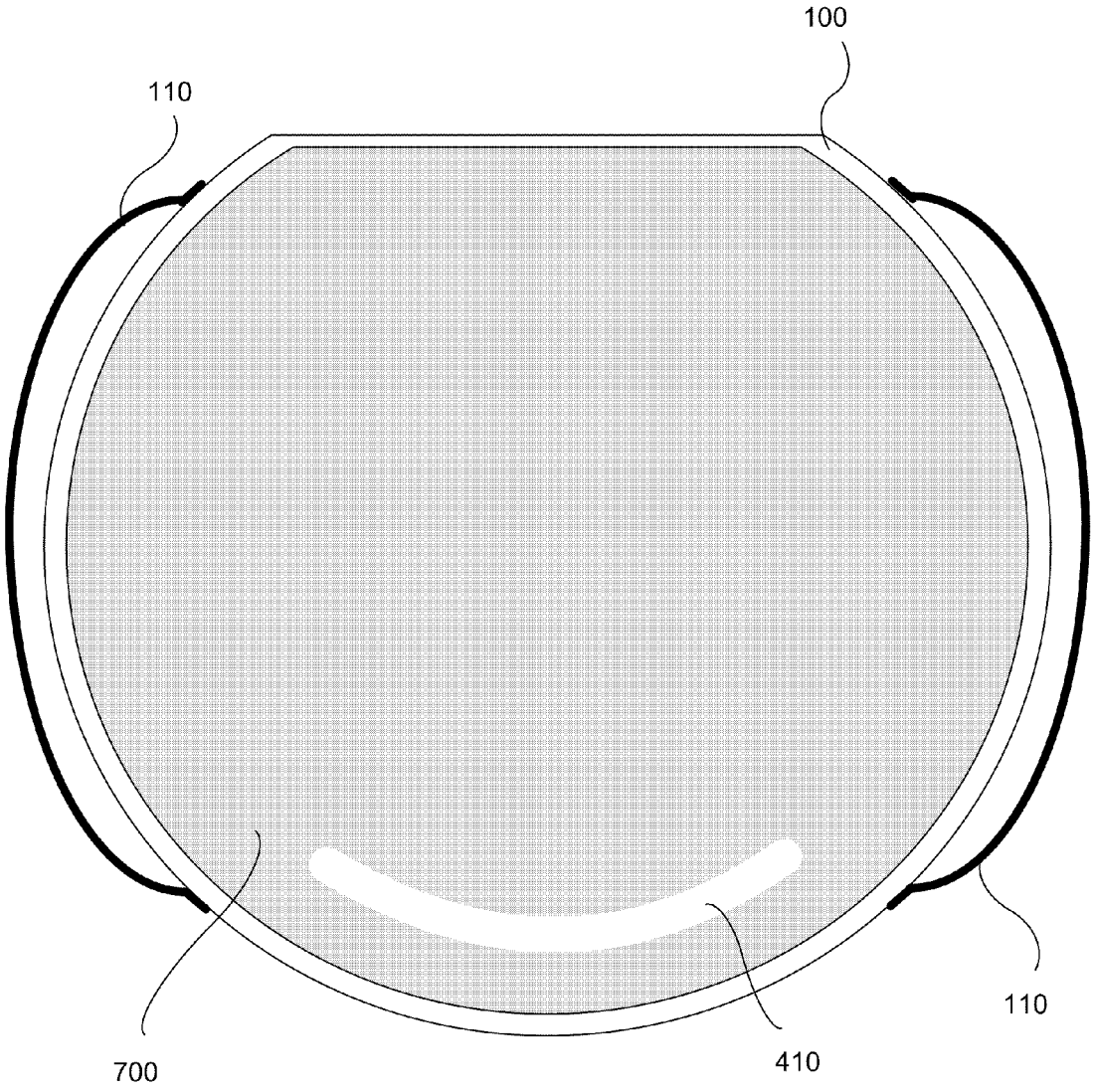
FIG. 7 is a top view of an alternative funnel molded into the tubular hub.

In an alternative embodiment shown in FIG. 7, a drainage funnel (700) is molded together with the tubular hub (100) in a unibody construction. In this embodiment, the drainage funnel (700) is configured to form an approximately horizontal platform to collect water and to flow water into a removable drainage tray. In this embodiment, there is no ledge (420) because the drainage funnel (700) serves in place of the ledge.

The fifth component of the dish rack noted above is a flat-panel grate (310). The flat-panel grate (310) is configured to rest horizontally on the drainage funnel (400). Because the flat-panel grate (310) rests horizontally when in service in the dish rack, it provides stability to dishware and other tableware when the dish rack is moved to a different location. The flat-panel grate (310) is preferably configured with a through-hole (312) or slot (311) in any configuration, but preferably at least one slot (311) configured to support and cradle the edge of a vertically standing plate in the dish rack and to allow drainage water to flow down to the drainage funnel (400).

Figure 5:
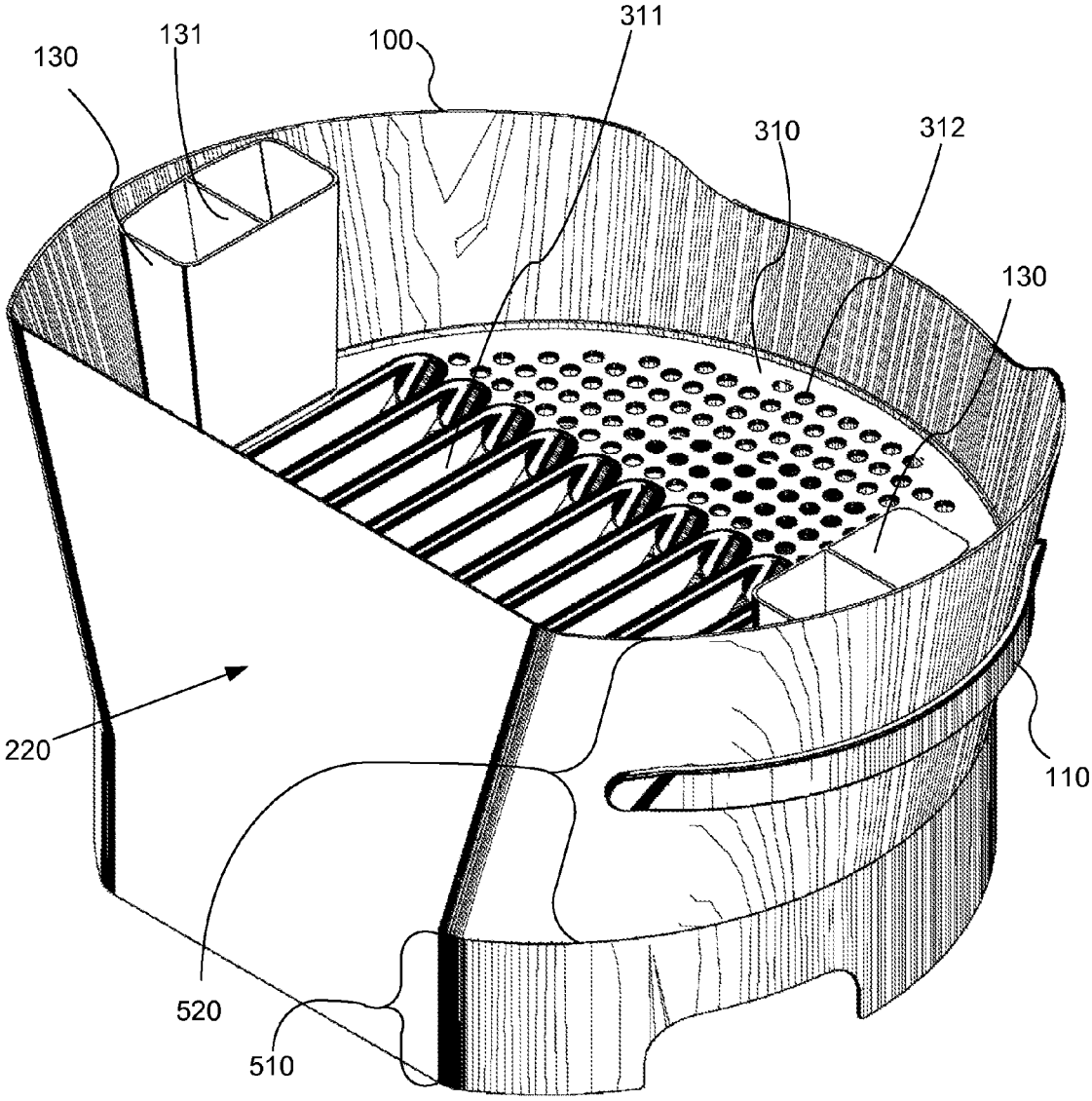
FIG. 5 is a rear perspective view of an assembled dish rack.

The sixth component of the dish rack noted above is an optional removable utensil holder (130) configured to be supported by the flat-plate grate (310) against the flared top segment (520). Preferably, the flat-plate grate (310) provides a receiving port (320) to support the removable utensil holder (130). There are preferably two removable utensil holders (130) as shown in FIG. 5. Each utensil holder (130) is preferably formed with a removable divider (131) for knives, forks, spoons and miscellaneous tableware.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

What is claimed is:

1. A dish rack comprising:

a tubular hub open at its top and bottom and comprising:

a bottom segment configured to stand approximately vertically and comprising an approximately elliptical front portion; and, a rear portion defining a planar vertical wall; wherein the bottom segment is further configured with a pair of cutouts on opposing sides of the bottom segment to define hand-hold cavities; and wherein the bottom segment is further configured with a drawer opening at the bottom of the front portion;

a top segment transitioning from the bottom segment at a transition point, wherein the top segment is flared outwardly beginning at the transition point to a vertical height along the front portion of the bottom segment, and extending the planar vertical wall of the bottom segment to a point above the vertical height of the front portion; and, a ledge at the transition point projecting radially inward, a removable drainage tray configured to slide into the drawer opening;

a plurality of handles on the exterior of the top segment, wherein each handle is configured to hold a dish towel;

a drainage funnel configured to rest on the ledge and collect water and flow water into the removable drainage tray; and, a flat-panel grate configured to rest horizontally on the drainage funnel.

2. The dish rack of claim 1 wherein the flat-panel grate is configured with a slot to support and cradle a dish edge.

3. The dish rack of claim 1 wherein the removable drainage tray comprises a pull bar configured to create a line of sight to a water level within the removable drainage tray.

4. The dish rack of claim 1 further comprising a removable utensil holder configured to be supported by the flat-panel grate against the flared top segment.

* * * * *